US008025390B2

(12) United States Patent
Phillips et al.

(10) Patent No.: US 8,025,390 B2
(45) Date of Patent: Sep. 27, 2011

(54) ESCORT BELT FOR IMPROVED PRINTING OF A MEDIA WEB IN AN INK PRINTING MACHINE

(75) Inventors: Scott J. Phillips, West Henrietta, NY (US); Roger G. Leighton, Rochester, NY (US); Elliott Allan Eklund, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1033 days.

(21) Appl. No.: 11/715,031

(22) Filed: Mar. 7, 2007

(65) Prior Publication Data

US 2008/0218576 A1 Sep. 11, 2008

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS

| | | | |
|---|---|---|---|
| 3,644,806 A | 2/1972 | Belson et al. | |
| 5,717,446 A | 2/1998 | Teumer et al. | |
| 6,254,092 B1 | 7/2001 | Yraceburu et al. | |
| 6,328,491 B1 | 12/2001 | Beehler et al. | |
| 6,394,596 B1 | 5/2002 | Wooton et al. | |
| 6,406,017 B1 * | 6/2002 | Yaneda | 271/276 |
| 6,543,948 B2 | 4/2003 | Beehler et al. | |
| 6,927,841 B2 | 8/2005 | Hinojosa et al. | |
| 2004/0027413 A1 | 2/2004 | Hebert et al. | |
| 2006/0050126 A1 | 3/2006 | Tanaka et al. | |

FOREIGN PATENT DOCUMENTS

| | | |
|---|---|---|
| EP | 1666259 | 6/2007 |
| JP | 08337011 | * 12/1996 |

OTHER PUBLICATIONS

EP Search Report, European Patent Office, Munich, Germany Jun. 26, 2008.

* cited by examiner

*Primary Examiner* — Jerry Rahll
(74) *Attorney, Agent, or Firm* — Maginot, Moore & Beck LLP

(57) ABSTRACT

An escort belt facilitates removal of particulate from a print zone in an ink printing machine while maintaining proper registration of printing media in the print zone. The escort belt includes an endless belt having a width between a first and a second edge of the escort belt that is greater than a media sheet carried by the escort belt, a first plurality of apertures arranged in a longitudinal line proximate one of the belt edges of the escort belt, and a second plurality of apertures distributed between the first plurality of apertures and the other edge of the escort belt, the apertures of the first plurality having a shape different from that of the second plurality of apertures and the apertures of the first aperture plurality being positioned so the apertures are only partially covered by edges of the media being held to the escort belt by a vacuum source applied to the first and the second pluralities.

14 Claims, 3 Drawing Sheets

ESCORT BELT FOR IMPROVED PRINTING OF A MEDIA WEB IN AN INK PRINTING MACHINE

TECHNICAL FIELD

This disclosure relates generally to ink printing machines, and, more particularly to ink printing machines that eject ink onto a moving media web.

BACKGROUND

Liquid ink printers having at least one print head from which droplets of ink are directed towards a recording sheet are well known. The print head in some liquid ink jet printers may contain an internal reservoir of ink as is known in ink jet printers. Other liquid ink printers, known generally as phase change ink printers, may be loaded with solid ink sticks that are delivered to a melter, which heats the solid ink stick to its melting point to produce liquid ink. The melted ink may then be collected in one or more reservoirs and distributed to one or more print heads. Within a print head of a liquid ink printer, ink is drawn into a plurality of channels. Power pulses to ink ejection components, such as piezoelectric ejection components, expel droplets of ink from orifices or nozzles of the print head.

A liquid ink print head may be incorporated into a printer that ejects ink onto a media sheet or a media web. A media sheet printer typically includes a supply drawer that houses a stack of media sheets. A feeder removes a sheet or media from the supply and delivers it into a feed path that directs the sheet past a print head so the print head ejects ink directly onto the sheet. In other types of sheet printers, a media sheet in the feed path is pressed into contact with a rotating intermediate member that bears ink, which has been ejected onto the member by one or more print heads.

Another type of printer is a web printer. In a web printer, a continuous supply of media, typically provided in a media roll, is mounted onto rollers that are driven by motors. A loose end of the media web is passed through a print zone opposite the print head or heads of the printer. Beyond the print zone, the media web is gripped and pulled by mechanical structures so a portion of the media web continuously moves through the print zone. Tension bars or rollers are placed in the feed path of the moving web to remove slack from the web so it remains taut without breaking.

One important aspect of these ink printing machines is the stability of the media sheet or web as it passes in front of a print head, which is ejecting ink onto the media. To improve stability of media passing in front of a print head, some printers incorporate a vacuum source that is coupled to vacuum platen. The vacuum platen includes a plurality of passageways or ports to enable air to be drawn through the platen towards the vacuum source. The vacuum platen is positioned and oriented so it is adjacent the back side of the media being printed by a print head. Thus, the air being pulled through the platen pushes the media against the platen to help stabilize the media while it is being printed.

In some known liquid ink printers that use a vacuum source and platen to help stabilize media being printed, an escort belt is also used to move the media along its feed path. An escort belt is typically provided with apertures. The escort belt is configured so it moves over the platen between the media sheet or web and the platen. The apertures in the belt enable air to be drawn through the belt and the passageways of the platen towards the vacuum source. The belt may be treated with friction-reducing material so the belt slides over the platen as it is pulled towards the platen. The escort belt improves the stability of the sheet or web media because it is flexible and its tautness may be adjusted by tension bars or roller.

While media transport systems using vacuum sources with platens and moving escort belts provide improved media stability during printing, an issue regarding debris in the vicinity of the print heads has been observed. Specifically, the airflow that pushes the media against the belt and platen may also displace debris from the media, especially when the media is fibrous, as is the case with paper. Debris displaced in the vicinity of the print head may clog an orifice or otherwise interfere with the ejection of ink onto the media. Reduction of displaced debris in the vicinity of the print head is therefore desirable in sheet printing and web printing machines.

In web printing machines, registration of the web media in the print zone opposite the print heads is important. While an escort belt and vacuum platen help properly maintain registration of the web media in the print zone, the air flow through the belt and the platen carries particulate debris. This debris may accumulate in the vacuum platen and eventually clog some of the passageways in the platen. Removal of this debris from the print zone without clogging the vacuum platen would be useful.

SUMMARY

An escort belt facilitates removal of particulate from a print zone in which media are being printed by a print head in an ink printing machine. The escort belt includes an endless belt having a width between a first and a second edge of the endless belt that is greater than a media sheet carried by the endless belt, a first plurality of apertures arranged in a longitudinal line proximate one of the belt edges, and a second plurality of apertures distributed between the first plurality of apertures and the other belt edge, the apertures of the first plurality having a shape different from that of the second plurality of apertures and the apertures of the first aperture plurality being positioned so the apertures of the first plurality are only partially covered by edges of the media being held to the endless belt by a vacuum source applied to the first and the second pluralities.

The escort belt may be incorporated in an ink jet printing machine to help remove debris from a duplex printing machine while maintaining registration of the media in the print zone. The ink jet printing machine includes a first print head assembly for ejecting ink onto a front surface of media, a second print head assembly for ejecting ink onto a back surface of the media, a first escort belt and a second escort belt, and at least one vacuum generator coupled to the escort belts. Each of the first and the second escort belts have a width between a first and a second edge of an escort belt that is greater than a media sheet carried by the escort belts. Each belt has a first plurality of apertures arranged in a longitudinal line proximate one edge of the escort belt, and a second plurality of apertures distributed between the first plurality of apertures and the other edge of the escort belt. The apertures of the second plurality have a shape different from that of the first plurality. The apertures of the first plurality are also positioned with respect to the second plurality of apertures so the apertures of the first plurality are only partially covered by edges of the media being held to an escort belt by a vacuum source applied to the first and the second aperture pluralities. The second escort belt is driven in a direction opposite the first direction to transport media through a print zone in front of at least one other ink jet print head. One or more vacuum generators are coupled to the apertures of the first and the second pluralities of the first escort belt and the second escort belt for maintaining registration of the media to the first and the second escort belts as the media passes through the two print zones and for removing particulates through the partially covered apertures of the first and the second escort belts.

DETAILED DESCRIPTION

Figure 1:
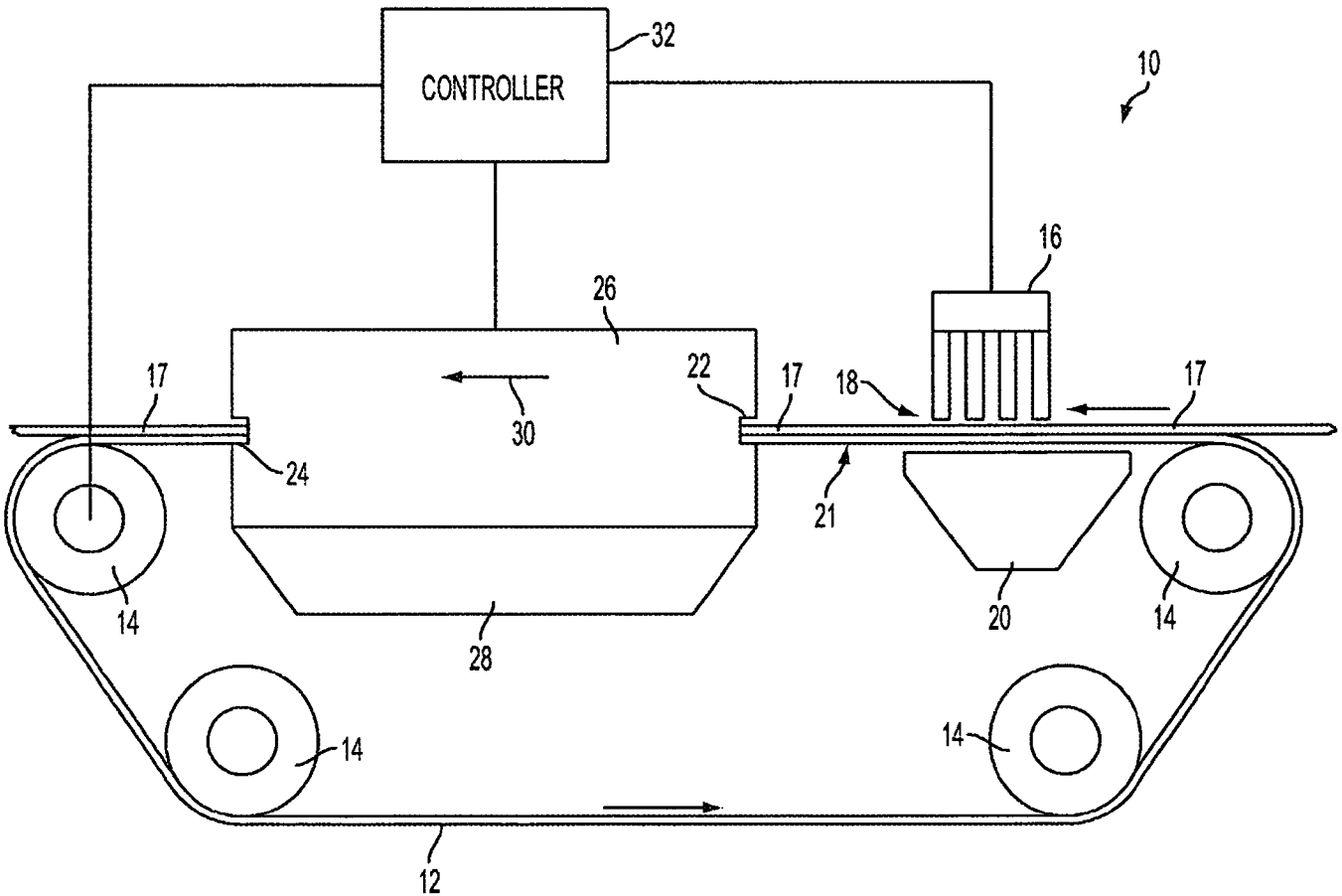
FIG. 1 PRIOR ART
FIG. 1 is a perspective view of a prior art liquid ink printer.

Like reference numerals refer to like parts throughout the following description and the accompanying drawings.

FIG. 1 illustrates a schematic side view of an ink-jet printer 10. The ink-jet printer 10 includes a web of media 17, such as paper stock, to be printed on by the ink-jet printer. The web is fed in a known manner to the escort belt 12 for transporting past the printing member 16. The escort belt 12 is driven by rollers 14. The printing member 16 may include one or more page width ink-jet print heads that deposit liquid ink on a sheet of paper or transparency or other printing media as the belt 12 carries the recording sheet past the printing member 16. The area in front of the print heads is sometimes referred to as a print zone. As illustrated, the printing member 16 includes four page-width print bars for printing full color images comprised of the colors cyan, magenta, yellow, and black. Each of the page-width ink-jet print bars includes a linear array of print nozzles so that ink is deposited across the sheet. The print member 16 includes an ink supply which may be either located with the print head or located elsewhere and connected to the print head through an ink conduit. In addition to an ink supply, the print member 16 includes the necessary electronics to control the deposition of ink on the individual sheets.

During printing, a portion of the web 17 is held to the escort belt 12 through a printing zone 18, by an applied vacuum from a first vacuum generator that is coupled to the vacuum platen 20. An inter-document region 21 may be located between the portions of the web that are printed by the printing member 16. Once printed, the web 17 may enter an input slot 22 of a dryer 26. The dryer 26 is attached to a second vacuum generator 28 for further application of a vacuum to the web 17 through the belt 12 as it traverses through the dryer 26 in the process direction indicated by arrow 30. The escort belt enables the use of a single belt for both imaging and drying. A single vacuum applicator may also be used to generate a vacuum in both the imaging region and the dryer 26. Once the web 17 has been dried by the dryer 26, it exits the output slot 24 and may be cut or otherwise processed (not shown). While a dryer 26 is shown in FIG. 1, a dryer is not required and the web 17 printed by the printing member 16 may air dry as it continues through the printing process. A controller 32 controls the printing member 16, the dryer 26, and the rollers 14, as would be understood by one skilled in the art. In addition, an adaptive dryer control for controlling the speed of the belt 12 through the dryer 26 may also be used, if a dryer is used with the escort belt 12.

The prior art escort belt used with the printer shown in FIG. 1 includes a plurality of apertures that enable vacuum hold down of a sheet as it passes through the printing zone 18. The air flow generated by the negative pressure of the vacuum generator, however, may displace debris from the recording media in the print zone. This debris may contribute to clogging of the print heads. To help reduce the amount of displaced debris that remains in the print zone, an escort belt has been developed that facilitates the removal of particulate from a print zone.

Figure 2:
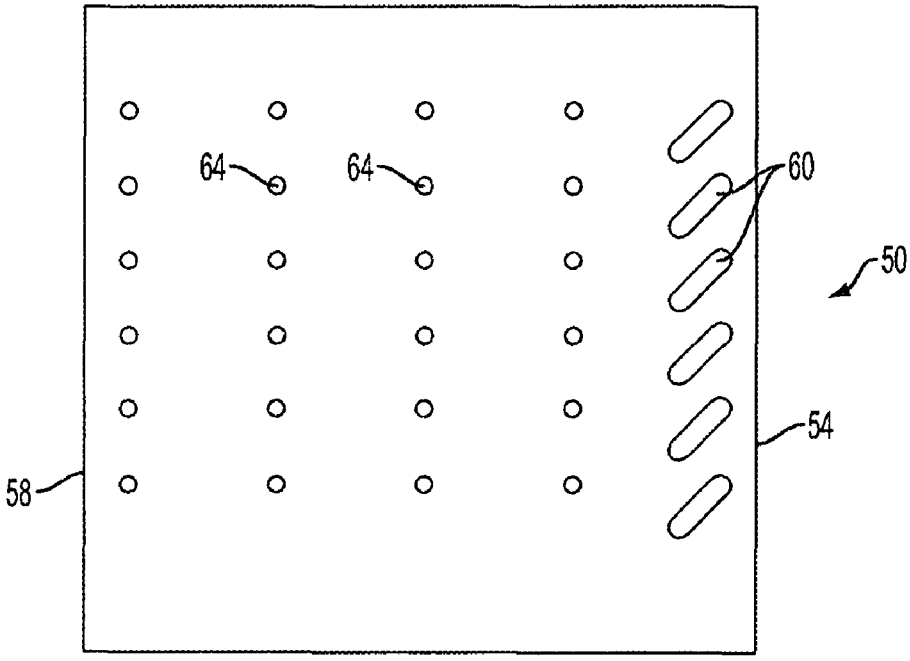
FIG. 2 is a front view of a transport belt that enables particulate removal from a print zone in a liquid ink printer.

One embodiment of an escort belt that helps remove particulate from a print zone is shown in FIG. 2. The escort belt is an endless belt 50 having a width between a first edge 54 and a second edge 58 that is greater than a media sheet to be carried by the endless belt. A first plurality of apertures 60 is arranged in a longitudinal line that is located near one of the first and the second edges of the endless belt. As shown in FIG. 2, the plurality of apertures 60 is located near belt edge 54. These apertures are located at a distance from the edge so they do not unduly weaken the transport belt. The belt 50 also includes a second plurality of apertures 64 that are distributed between the other belt edge, which in FIG. 2 is the belt edge 58, and the first plurality of apertures 60. These apertures primarily hold the media against a platen when a vacuum source is coupled to the apertures. While the plurality of apertures 60 is shown as being arranged along the first edge 54 of the belt 50, the plurality of apertures 60 could be alternatively arranged along the second edge 58 of the belt 50. Also, the terms "first" and "second" are used to facilitate reference to the structure of the belt and its components and do not refer to specific left or right, up or down directions. The escort belt 50 may be made from a variety of materials including metal, Kapton, polyamide, or other flexible materials that are not adverse to heat up to a temperature of approximately 70° C.

With further reference to FIG. 2, the apertures of the first plurality 60 have a shape that is different from the shape of the second plurality of apertures 64. In the depicted embodiment, the apertures in the plurality 60 are elliptical and the apertures in the plurality 64 are circular. The apertures of the plurality 60 are preferably longer and positioned between the plurality 64 and one of the belt edges so the apertures of the plurality 60 are only partially covered by edges of the media held to the escort belt 50 by a vacuum source applied to the apertures of the belt. This relationship is depicted in FIG. 3.

Figure 3:
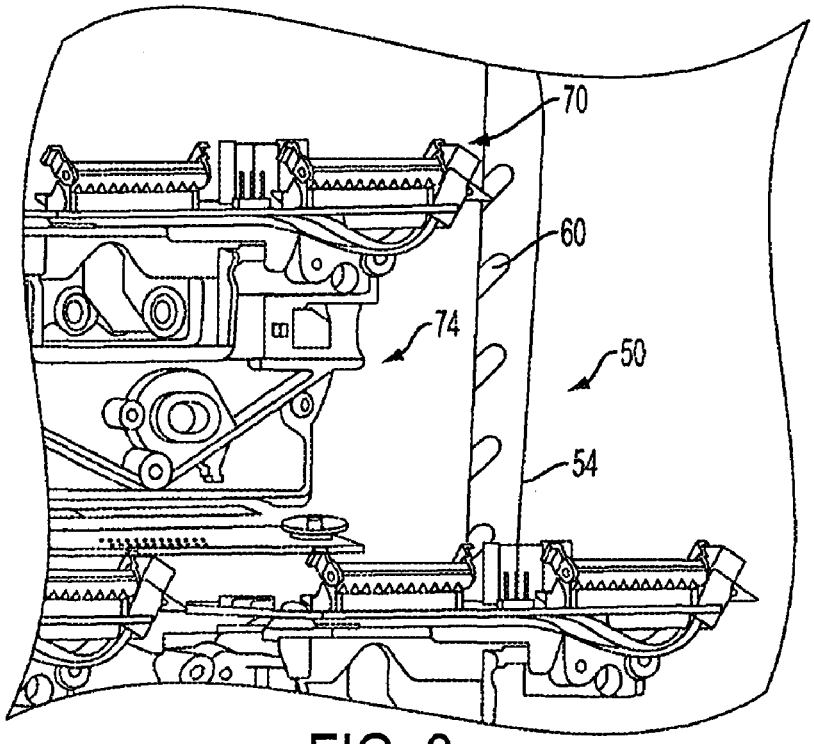
FIG. 3 is a perspective view looking through a print head assembly to media being held on the transport belt shown in FIG. 2.

As shown in FIG. 3, the media 70 is held to the belt 50 in the print zone 74 opposite the print heads 78 by the vacuum applied to the plurality of apertures 64. The application of the vacuum to the plurality of apertures 60 pulls particulate out of the print zone 74. By making the apertures of the longitudinally arranged plurality 60 longer than the apertures of the plurality 64, which are more centrally located on the belt 50, a tolerance is provided for placement of the media on the belt without completely covering the apertures of the longitudinally arranged plurality 60.

With the escort belt 50, particulate, such as displaced debris, is pulled from the print zone through the partially covered apertures 60. This collected debris may be exhausted at a port for the vacuum generator or collected in a filter or other particulate receptacle. Because the debris is collected at the edges of the web, the risk of passageways in the vacuum platen in the central area of the platen are reduced. This feature helps ensure proper registration of the web as it passes through the printing zone. A sufficient number of apertures are provided at the edges of the media that all or substantially all of the apertures are unlikely to clog before regular maintenance of the printing machine. Thus, the apertures of the plurality 64 are positioned for holding the media through a print zone and the apertures of the plurality 60 help ensure an air flow that pulls particulate and other debris from the print zone.

While the embodiment shown in FIG. 2 depicts circular and elliptical apertures, other shapes may be used. For example, the apertures of the plurality 64 may be square and the apertures of the plurality 60 may be rectangular. Rectangular refers to the apertures being having one pair of parallel sides that are longer than the other pair of parallel sides. Of course, other shapes and positions may be used as long as the apertures between the media holding apertures and one edge of the belt 50 are positioned and sized so they are only partially covered by media held to the belt as it moves through a print zone.

As shown in FIG. 2, the apertures located near the edge 54 of the belt 50 are oriented at an angle with respect to a line that is orthogonal to and extends between the first and the second edges of the escort belt. This angular positioning extends the opening between the media and the end of an aperture in the longitudinal direction of the belt. This arrangement extends the air flow pattern generated by the air being pulled through the apertures to cover more completely the length of the media in the print zone. In another embodiment, another plurality of longitudinally arranged apertures may be formed in the belt 50 between the plurality 64 and the edge 58 of the belt 50. This plurality of apertures has a shape that is different from the shape of the apertures in the plurality 64. Also, the second plurality of longitudinally arranged apertures may be oriented at an angle with respect to a line that is orthogonal to and extends between the first and the second edges of the escort belt. Additionally, the longitudinally arranged apertures near one edge of the belt and the longitudinally arranged apertures near the other edge of the belt may be staggered with respect to one another to cover more completely the media in the print zone with an evacuating air flow.

Figure 4:
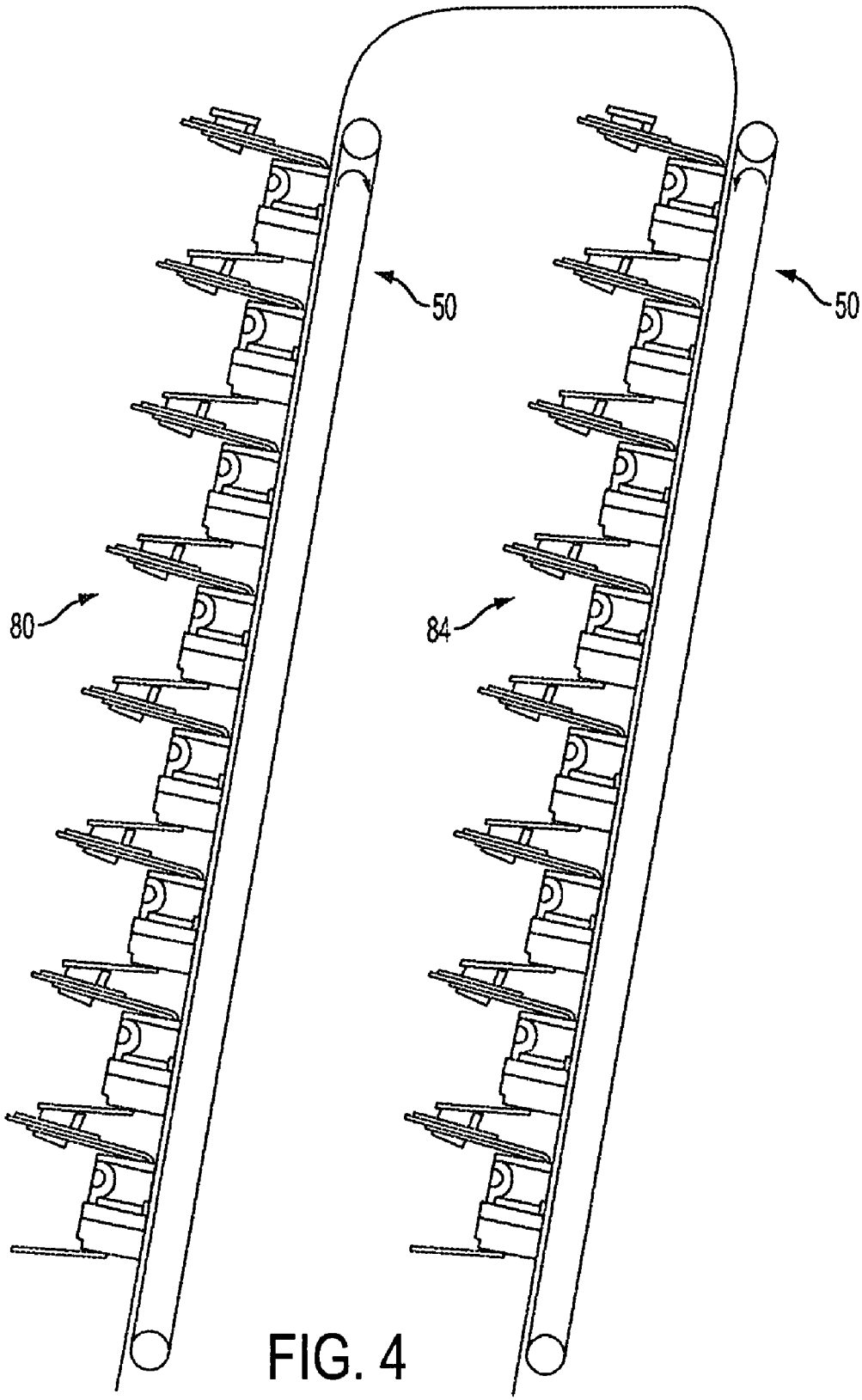
FIG. 4 is a view of two transport belts that enables a duplex printer to remove particulate from two print zones.

As shown in FIG. 4, two escort belts may be arranged to enable duplex printing of media while helping to remove particulate from both print zones. The cleaning function of the air flow at the edges helps prevent the print heads from clogging and the preservation of the vacuum passageways in the central area of the platens and the escort belts helps maintain proper registration of the web. Proper registration is enabled by the use of escort belts that provide a backing surface that is consistently flatter than a series of rollers. The more reliably planar surfaces of the escort belts reduce the amount of relative slippage between the media and its backing surface. This reduction in slippage results in less abrasion for the image on the back side of media being printed in a duplex printing operation. Thus, the image that has already been printed on the other side of the web is better preserved by the use of escort belts.

With further reference to FIG. 4, a first assembly of print heads 80 is arranged opposite a first escort belt 50 configured with a vacuum generator as described above. The path of the media then bends, in the embodiment shown in the figure, so it passes between a second assembly of print heads 84 and a second escort belt 50 that is configured as described above. The second escort belt, however, is driven in a direction that is opposite to the direction in which the first escort belt is driven. Alternatively, the second print head assembly may be positioned vertically above the first escort belt 50 and the second escort belt 50 may be positioned vertically above the first print head assembly 80. Again, the second escort belt is driven in a direction that is opposite to the direction in which the first escort belt is driven.

As the media passes into the print zone between the first print head assembly 80 and the first escort belt 50, the vacuum applied to the plurality of apertures 64 rigidly hold the media to the belt while the vacuum applied to the plurality of apertures 60 generate an air flow that helps pull particulate from the print zone through the partially uncovered apertures 60 for exhaustion or storage elsewhere. The first print head assembly ejects ink onto the media surface facing the print head assembly. As the media enters the second print zone, the vacuum applied to the plurality of apertures 64 pulls the side of the media printed by the first print head assembly to the second escort belt. The second print head assembly ejects ink onto the other side of the media. The vacuum applied to the plurality of apertures 60 pull particulate from the second print zone through the apertures partially covered by the media.

While the various embodiments presented above have been discussed with reference to a page width print head, the belt is equally applicable to printers having an ink-jet print head which forms an image by moving across media periodically in swaths, to printers having staggered arrays of print heads, and to printers having a single print bar. Additionally, while the belt has been discussed as being used with media sheets, similarly configured belts may be used in printers that eject ink onto media webs. Therefore, those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A system for removing debris in the vicinity of media edges comprising:

a first escort belt that is driven in a first direction to transport media through a first print zone in front of at least one ink jet print head, the first escort belt having:

a width between a first and a second edge of the escort belt that is greater than a media sheet carried by the first escort belt;

a first plurality of apertures arranged in a longitudinal line proximate one of the first and the second belt edges of the first escort belt; and a second plurality of apertures distributed between the longitudinal line formed by the first plurality of apertures and the other edge of the first escort belt, the apertures of the first plurality of apertures having a shape with a length that is greater than a width of the aperture shape, the apertures of the first plurality of apertures being positioned on the first escort belt to enable the apertures of the first plurality of apertures to be only partially covered by media being held to the first escort belt by a vacuum source applied to the first plurality of apertures and to the second plurality of apertures, the second plurality of apertures having a shape that is different than the shape of the apertures in the first plurality of apertures;

a second escort belt that is driven in a direction opposite the first direction to transport media through a second print zone in front of at least one other ink jet print head, the second escort belt having:

a width between a first and a second edge of the second escort belt that is greater than a media sheet carried by the second escort belt;

a first plurality of apertures arranged in a longitudinal line proximate one of the first and the second belt edges of the second escort belt; and a second plurality of apertures distributed between the longitudinal line formed by the first plurality of apertures and the other edge of the second escort belt, the apertures of the first plurality of apertures having a shape with a length that is greater than a width of the aperture shape, the apertures of the first plurality of apertures being positioned on the second escort belt to enable the apertures of the first plurality of apertures to be only partially covered by media being held to the second escort belt by a vacuum source applied to the first plurality of apertures and the second plurality of apertures, the second plurality of apertures having a shape that is different than the shape of the apertures in the first plurality of apertures; and at least one vacuum generator coupled to the apertures of the first plurality of apertures and the apertures of the second plurality of apertures of the first escort belt as media are receiving ink ejected by the at least one ink jet print head in the first print zone and coupled to the apertures of the first plurality of apertures and the apertures of the second plurality of apertures of the second escort belt as media are receiving ink ejected by the at least one other ink jet print head in the second print zone, the apertures of the second plurality of apertures of the first escort belt and the apertures of the second plurality of apertures of the second escort belt enabling the at least one vacuum generator to hold media rigidly to the first escort belt and the second escort belt as the media passes through the first print zone and the second print zone, respectively, and the apertures of the first plurality of apertures of the first escort belt and the apertures of the first plurality of apertures of the second escort belt enabling the at least one vacuum generator to remove particulates through the partially covered apertures of the first plurality of apertures of the first escort belt and through the partially covered apertures of the first plurality of apertures of the second escort belt as the media pass through the first print zone and the second print zone, respectively.

2. The system of claim 1, the first escort belt further comprising:

a third plurality of apertures arranged in a longitudinal line between the second plurality of apertures and the other edge of the first escort belt; and the second escort belt further comprising:

a third plurality of apertures arranged in a longitudinal line between the second plurality of apertures and the other edge of the second escort belt.

3. The system of claim 1, the apertures of the first plurality of apertures of the first escort belt being generally elliptical and the apertures of the first plurality of apertures of the second escort belt being generally elliptical and the apertures of the second plurality of apertures of the first escort belt and the apertures of the second plurality of the second escort belt being generally circular.

4. The system of claim 3, the elliptically shaped apertures of the first plurality of apertures of the first escort belt being oriented at an acute angle with respect to a line orthogonal to the first and the second edges of the first escort belt.

5. The system of claim 4, the elliptically shaped apertures of the first plurality of apertures of the second escort belt being oriented at an acute angle with respect to a line orthogonal to the first and the second edges of the second escort belt.

6. The system of claim 1, the apertures of the first plurality of apertures of the first escort belt and the apertures of the second plurality of apertures of the second escort belt being generally rectangular and the apertures of the second plurality of apertures the first escort belt and the apertures of the second plurality of apertures of the second escort belt being generally square.

7. The system of claim 6, the rectangular apertures of the first plurality of apertures of the first escort belt being oriented at an acute angle with respect to a line orthogonal to the first and the second edges of the first escort belt; and the rectangular apertures of the first plurality of apertures of the second escort belt being oriented at an acute angle with respect to a line orthogonal to the first and the second edges of the second escort belt.

8. An ink jet printing machine for printing on a front and a back side of a web media comprising:

a first print head assembly for ejecting ink onto a front surface of media in a first print zone;

a second print head assembly for ejecting ink onto a back surface of the media in a second print zone;

a first escort belt that is driven in a first direction to transport media through the first print zone in front of the first print head assembly, the first escort belt having:

a width between a first and a second edge of the escort belt that is greater than a media sheet carried by the first escort belt;

a first plurality of apertures arranged in a longitudinal line proximate one edge of the first and second edges of the first escort belt;

a second plurality of apertures distributed between the longitudinal line formed by the first plurality of apertures and the other edge of the first escort belt, the apertures of the first plurality of apertures having a shape with a length that is greater than a width of the aperture shape, the apertures of the first plurality of apertures being positioned on the first escort belt with respect to the second plurality of apertures to enable the apertures of the first plurality of apertures to be only partially covered by edges of the media being held to the first escort belt by a vacuum source applied to the first plurality of apertures and the second plurality of apertures;

a second escort belt that is driven in a direction opposite the first direction to transport media through a second print zone in front of the second print head assembly, the second escort belt having:

a width between a first and a second edge of the second escort belt that is greater than a media sheet carried by the second escort belt;

a first plurality of apertures arranged in a longitudinal line proximate one edge of the first and second edges of the second escort belt;

a second plurality of apertures distributed between the first plurality of apertures and the other edge of the second escort belt, the apertures of the first plurality of apertures having a shape with a length that is greater than a width of the aperture shape, the apertures of the first plurality of apertures being positioned on the second escort belt with respect to the second plurality of apertures to enable the apertures of the first plurality of apertures to be only partially covered by media being held to the second escort belt by a vacuum source applied to the first plurality of apertures and the second plurality of apertures; and at least one vacuum generator coupled to the apertures of the first plurality of apertures and to the apertures of second plurality of apertures of the first escort belt and to the apertures of the first plurality of apertures and the apertures of the second plurality of apertures of the second escort belt, the apertures of the second plurality of apertures in the first escort belt and the apertures of the second plurality of apertures in the second escort belt enabling the at least one vacuum generator to hold media against the first escort belt and the second escort belt, respectively, as the media passes through the first print zone and the second print zone, respectively, and the apertures of the first plurality of apertures in the first escort belt and the apertures of the first plurality of apertures in the second escort belt enabling the at least one vacuum generator to remove particulates through the partially covered apertures of the first plurality of apertures of the first escort belt and the second escort belt, respectively, as the media moves through the first print zone and the second print zone, respectively.

9. The system of claim 8, the first escort belt further comprising:

a third plurality of apertures arranged in a longitudinal line between the second plurality of apertures and the other edge of the first escort belt; and the second escort belt further comprising:

a third plurality of apertures arranged in a longitudinal line between the second plurality of apertures and the other edge of the second escort belt.

10. The system of claim 8, the apertures of the first plurality of apertures of the first escort belt and the apertures of the first plurality of apertures of the second escort belt being generally elliptical and the apertures of the second plurality of apertures of the first escort belt and the apertures of the second plurality of apertures of the second escort belt being generally circular.

11. The system of claim 10, wherein the generally elliptical apertures of the first plurality of apertures of the first escort belt are oriented at an acute angle with respect to a line orthogonal to the first and the second edges of the first escort belt.

12. The system of claim 11, wherein the generally elliptical apertures of the first plurality of apertures of the second escort belt are oriented at an acute angle with respect to a line orthogonal to the first and the second edges of the second escort belt.

13. The system of claim 8, wherein the apertures of the first plurality of apertures of the first escort belt and the apertures of the first plurality of apertures of the second escort belt are generally rectangular and the apertures of the second plurality of apertures of the first escort belt and the apertures of the second plurality of apertures of the second escort belt are generally square.

14. The system of claim 13, wherein the generally rectangular apertures of the first plurality of apertures of the first escort belt are oriented at an acute angle with respect to a line orthogonal to the first and the second edges of the first escort belt; and the generally rectangular apertures of the first plurality of apertures of the second escort belt being oriented at an acute angle with respect to a line orthogonal to the first and the second edges of the second escort belt.

* * * * *